US006636002B2

(12) United States Patent
Kim

(10) Patent No.: US 6,636,002 B2
(45) Date of Patent: Oct. 21, 2003

(54) FIELD EMISSION DISPLAY, METHOD FOR MEASURING VACUUM DEGREE THEREOF AND METHOD FOR AUTOMATICALLY ACTIVATING GETTER THEREOF

(75) Inventor: Kwang Young Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 27 days.

(21) Appl. No.: 10/038,593

(22) Filed: Jan. 3, 2002

(65) Prior Publication Data

US 2002/0089289 A1 Jul. 11, 2002

(30) Foreign Application Priority Data

Jan. 5, 2001 (KR) ..... 2001/00529

(51) Int. Cl.[7] ..... G09G 3/10; G09G 3/28

(52) U.S. Cl. ..... 315/169.3; 345/74

(58) Field of Search ..... 315/169.1, 169.3, 315/169.4; 345/74, 76; 445/24, 29, 50, 51, 53

(56) References Cited

U.S. PATENT DOCUMENTS 5,593,335 A * 1/1997 Suzuki et al. ..... 445/50
5,847,495 A * 12/1998 Yamanobe et al. ..... 313/310
6,059,627 A * 5/2000 Dean et al. ..... 445/24
6,144,350 A * 11/2000 Fujii et al. ..... 345/74.1
6,169,356 B1 * 1/2001 Ohnishi et al. ..... 313/495
6,231,412 B1 * 5/2001 Kawade et al. ..... 445/3
6,246,178 B1 * 6/2001 Isono ..... 315/169.3
6,344,711 B1 * 2/2002 Ohnishi et al. ..... 313/495
6,384,541 B1 * 5/2002 Ohnishi et al. ..... 315/169.3

* cited by examiner

*Primary Examiner*—Don Wong
*Assistant Examiner*—Ming D A
(74) *Attorney, Agent, or Firm*—Lee & Hong

(57) ABSTRACT

The present invention discloses a field emission display including: a monitoring emitter applied to a constant voltage wherein the monitoring emitter is installed at an outer portion of an active area of a cathode plate; and a current measuring electrode applied to a constant voltage to measure the current flowing to the monitoring emitter wherein the current measuring electrode is disposed at an outer portion of an active area of an anode plate. In addition, a method for measuring a vacuum degree of a field emission display, includes the steps of: measuring current variations of a monitoring emitter by electron emission of a display emitter, when the vacuum degree is changed by gas molecules outgassed from a panel of the FED; and monitoring variations of the vacuum degree in the panel of the FED according to the variations of the measured anode current.

10 Claims, 4 Drawing Sheets

FIELD EMISSION DISPLAY, METHOD FOR MEASURING VACUUM DEGREE THEREOF AND METHOD FOR AUTOMATICALLY ACTIVATING GETTER THEREOF

BACKGROUND OF THE INVENTION

1. Field of the Invention

The present invention relates to a field emission display, and in particular to a field emission display (FED), a method for measuring a vacuum degree thereof, and a method for automatically activating a getter thereof which can constantly maintain the vacuum degree of an FED panel during an operation period, by monitoring variations of the vacuum degree in the panel, and feeding back variations of an anode current to a getter heating device to automatically reactivate the getter when a current value of the anode is reduced over a predetermined value.

2. Description of the Related Art

Generally, the FED requires an internal vacuum degree of a panel below $10^{-7}$Torr during the operation in the same way as CRT.

However, gases such as $O_2$, $H_2O$, $CO_2$, CO, $H_2$ and $CH_4$ are generated from a fluorescent material, metal, insulating material and glass substrate during the operation of the FED. Since the oxidative gases such as $O_2$, $H_2O$, $CO_2$ and CO oxidize a metal tip particularly, a work function of the metal tip is changed so as to deteriorate an electron emission property.

In addition, the emitted gas molecules collide with electrons emitted from the metal tip, and thus are ionized to generate metal positive ions. The metal positive ions are accelerated toward the cathode due to a high electric field between the panels, and sputters the metal tip, thereby damaging the metal tip.

As publicly known, when the FED has been used for a long time (over about 10,000 hours), the vacuum degree of the panel is increased by $10^{-3}$Torr. Here, discharge between the anode and the cathode may seriously damage the panel.

In order to solve the foregoing problems, there has been suggested a method for increasing a vacuum degree of a panel through the adsorption of internal gases by using a getter. That is, the getter removes reactive gases such as $O_2$, $H_2O$, $CO_2$, CO, $H_2$ and $CH_4$ according to chemical reaction with the gases on the activated surface. The getter is divided into an evaporation type getter and a non-evaporation type getter. The evaporation type getter is a mixture of $BaAl_4$ alloy and Ni powder which is put in a special vessel. In addition, the evaporation type getter requires a high temperature heating activation process at a temperature of 850° C.

Currently, the evaporation type getter has been applied to the CRT having a large exhaust space. However, when the evaporation type getter is applied to the FED, it is difficult for the evaporation type getter to be applied because the substrate glass cannot endure such a high activation temperature.

The non-evaporation type getter contains a metal alloy of Zr and Ti and a slight amount of Al, V and Fe. Since an activation temperature of the non-evaporation type getter is about 400° C., the non-evaporation type getter is applied to the FED. However, the getter applied to the FED is activated once in an initial sealing process, and the surface of the getter is gradually saturated by gas particles outgassed from the panel. When the surface of the getter is completely covered by the surface adsorption of the gas molecules, the getter cannot normally play a part in a pump.

Accordingly, when the FED is used, the surface of the getter should be cleaned by periodically reactivating the getter. However, the getter applied to the conventional FED cannot be reactivated during use of the FED. It is also difficult to precisely measure a reactivation point of the getter.

SUMMARY OF THE INVENTION

In accordance with the present invention, a field emission display (FED) includes: a monitoring emitter being installed at an outer portion of an active area of a cathode plate, and receiving a constant voltage; and a current measuring electrode being disposed at an outer portion of an active area of an anode plate, and receiving a constant voltage to measure the current flowing to the monitoring emitter.

Here, the current measuring electrode is positioned to face the monitoring emitter, and the constant voltage is applied thereto, individually from a display voltage of the cathode plate and the anode plate.

In addition, a method for measuring a vacuum degree of an FED includes the steps of: measuring current variations of a monitoring emitter in electron emission of a display emitter, when the vacuum degree is changed by gas molecules outgassed from a panel of the FED; and monitoring variations of the vacuum degree in the panel of the FED according to the measured current variations of the anode.

A method for automatically activating a getter of an FED includes the steps of: setting up an aimed vacuum degree according to an optimal operation state of the FED; measuring an anode current in the aimed vacuum degree by a voltage applied to a monitoring emitter and a voltage applied to a current measuring electrode, and feeding back the anode current to a heating device of the getter; and automatically operating the heating device to automatically reactivate the getter, when the current of the anode is reduced from a current value for the aimed vacuum degree below a predetermined range.

The aimed vacuum degree ranges from $10^{-8}$Torr to $10^{-6}$Torr.

BRIEF DESCRIPTION OF THE DRAWINGS

The above objects, features and advantages of the present invention will become more apparent from the following detailed description when taken in conjunction with the accompanying drawings, in which.

DETAILED DESCRIPTION OF THE PREFERRED EMBODIMENT

Figure 1:
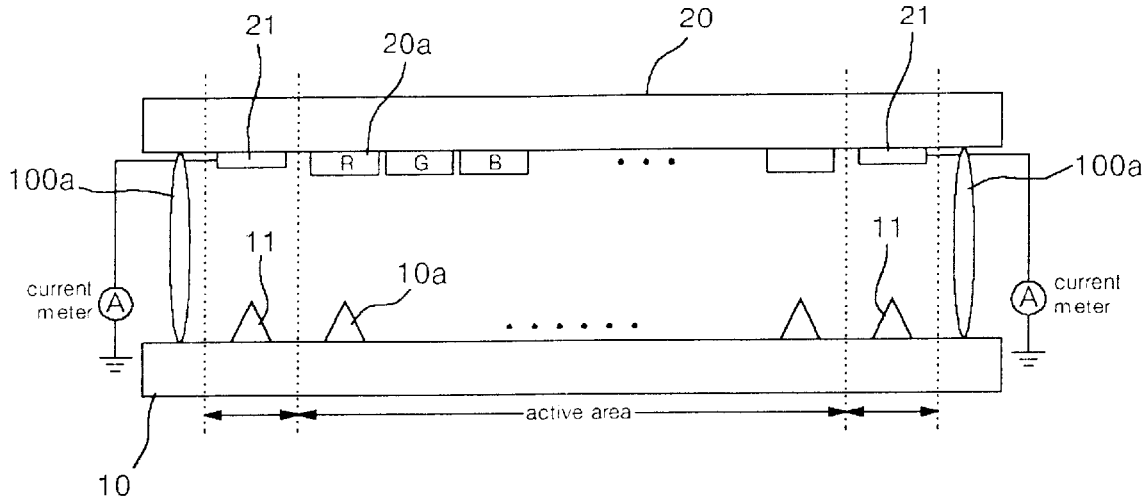
FIG. 1 is a schematic cross-sectional diagram illustrating an FED for measuring a vacuum degree in accordance with the present invention.

A preferred embodiment of the present invention will now be described with reference to the accompanying drawings. In the following description, same drawing reference numerals are used for the same elements even in different drawings. The matters defined in the description such as a detailed construction and elements of a circuit are nothing but the ones provided to assist in a comprehensive understanding of the invention. Thus, it is apparent that the present invention can be carried out without those defined matters. Also, well-known functions or constructions are not described in detail since they would obscure the invention in unnecessary detail.

Figure 2:
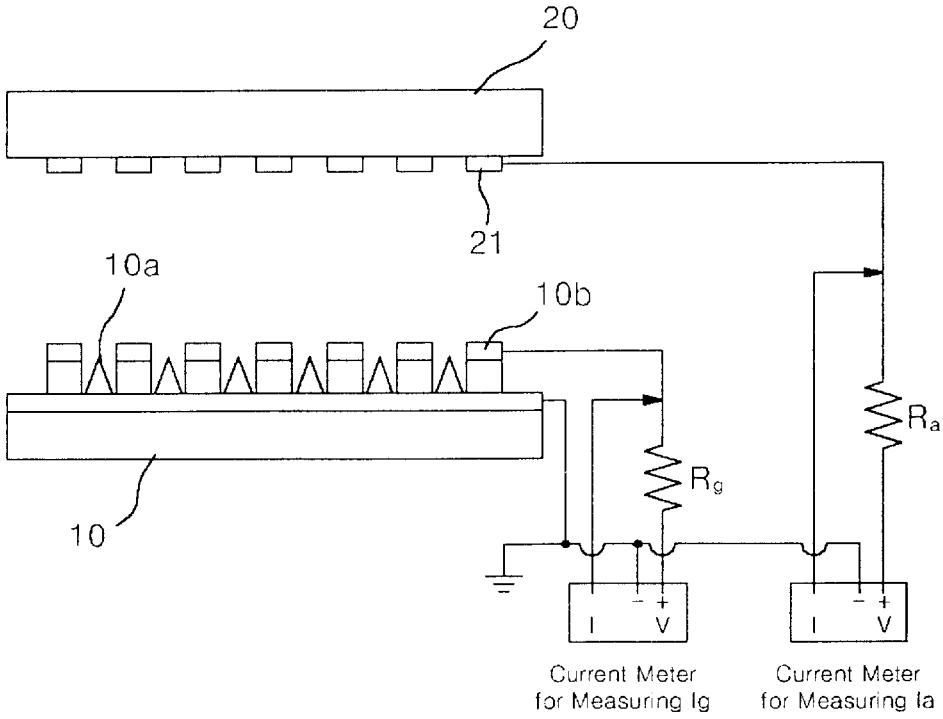
FIG. 2 is an equivalent circuit diagram illustrating the FED for measuring an anode current for measuring a vacuum degree in accordance with a preferred embodiment of the present invention.

FIG. 1 is a schematic cross-sectional diagram illustrating a field emission display (FED) for measuring a vacuum degree in accordance with the present invention. FIG. 2 is an equivalent circuit diagram illustrating the FED for measuring an anode current for measuring a vacuum degree in accordance with the preferred embodiment of the present invention. Referring to FIG. 1 and FIG. 2, the FED for measuring the vacuum degree includes: a cathode plate 10 having a display emitter 10*a* which is an electron emission source and a gate 10*b* in an active area, and a monitoring emitter 11 receiving a constant voltage Vg-c, at the outer portion of the active area in its lower portion from a spacer 100*a* for maintaining a vacuum degree gap; and an anode plate 20 having a display fluorescent material 20*a* in an active area, and a current measuring electrode 21 receiving a constant voltage for measuring a current flowing to the monitoring emitter 11, at the outer portion of the active region in its upper portion from the spacer 100*a*.

Figure 3:
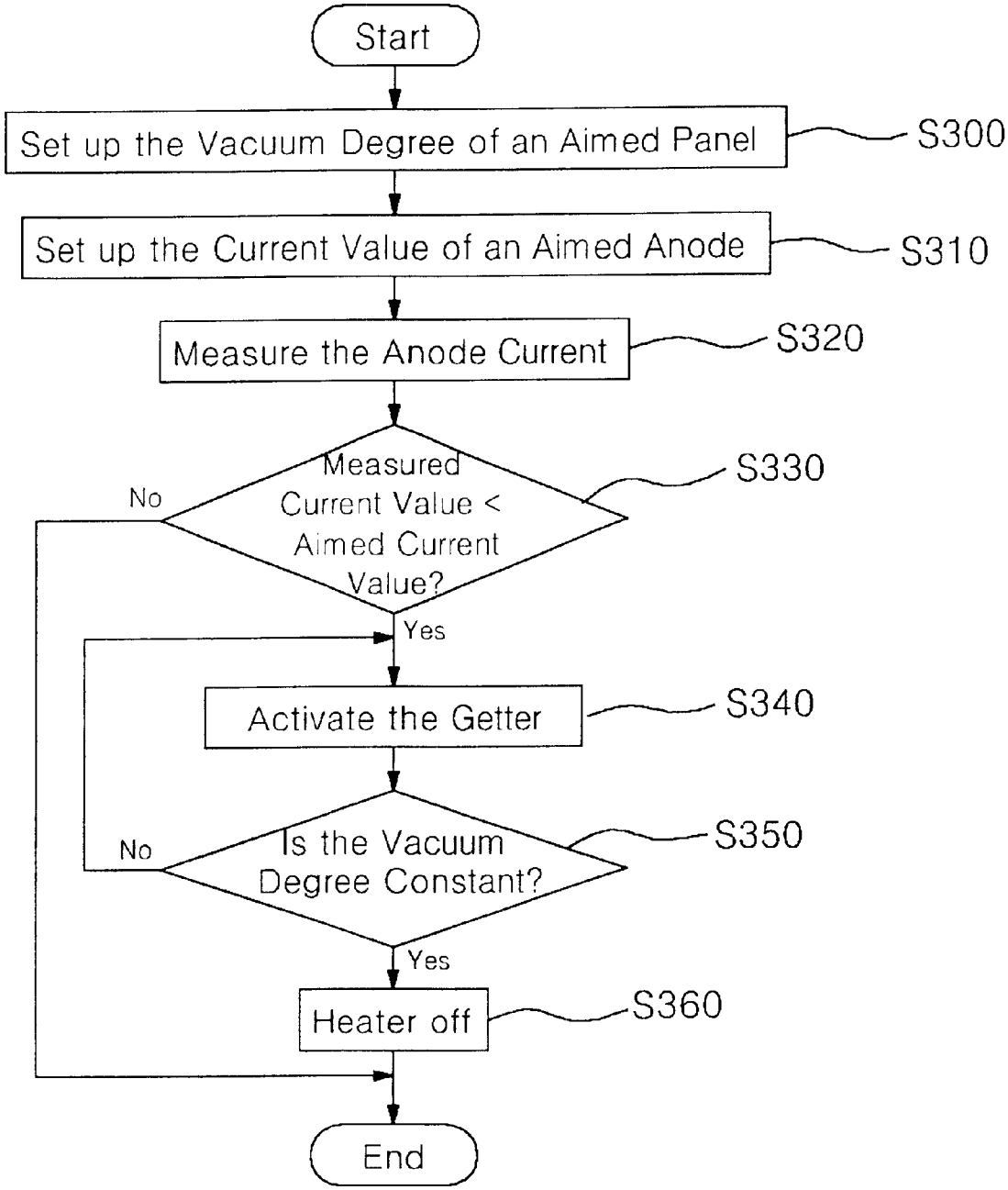
FIG. 3 is a flowchart illustrating a method for automatically activating a getter in accordance with the preferred embodiment of the present invention.
Figure 4:
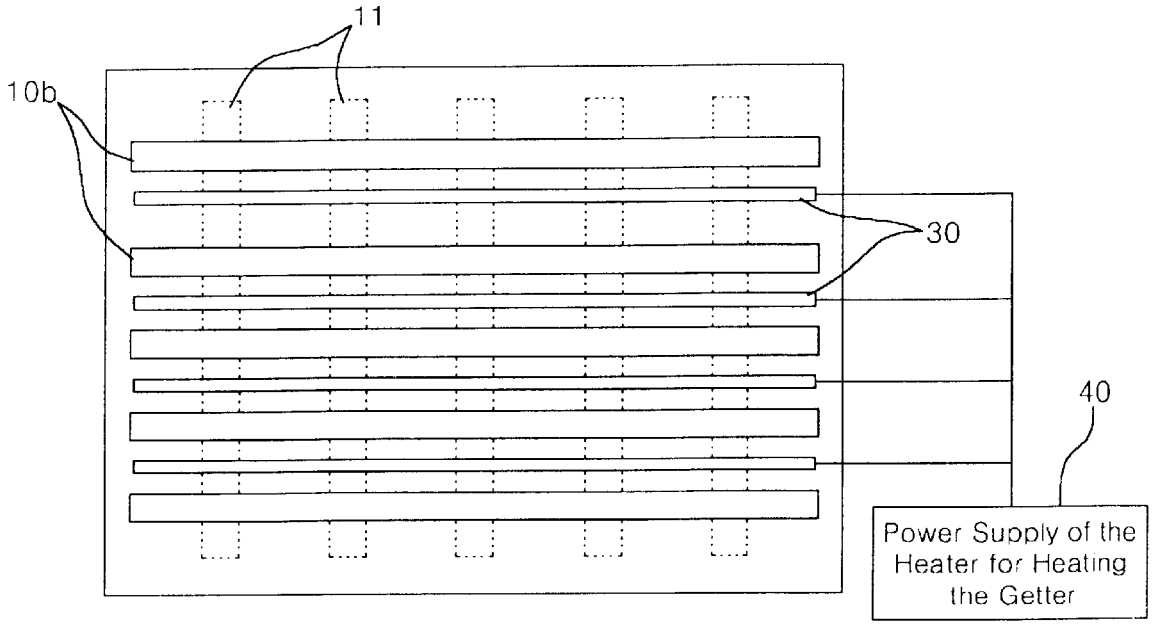
FIG. 4 is an alignment diagram in a cathode plate of a thin film getter in accordance with the preferred embodiment of the present invention.

FIG. 3 is a flowchart illustrating a method for automatically activating a getter for constantly maintaining the measured vacuum degree, and FIG. 4 is an alignment diagram in the cathode plate of the thin film getter in accordance with the preferred embodiment of the present invention. Still referring to FIGS. 1 to 4, the method for activating the getter includes the steps of: setting up an aimed vacuum degree and an aimed anode current value according to an optimal operation state of the FED (S300 and S310); measuring the anode current flowing to the voltage Vg-c applied to the monitoring emitter 11 and the voltage applied to the current measuring electrode 21 in the aimed vacuum degree (S320); feeding back the measured anode current to a heating device 40 of the getter 30 and automatically operating the heating device to automatically reactivate the getter, when the fed-back anode current is reduced from a current value for the aimed vacuum degree below a predetermined range (S330 and S340); and turning off the heating device 40 when the vacuum degree of the FED panel is constantly maintained during the operation period (S350 and S360).

As depicted in FIG. 4, the getter 30 is a non-evaporation type getter mounted on the cathode plate 10. The getter 30 is deposited in a thin film type on a space between the electrodes of the gate 10*b* according to a sputtering method. Generally, the getter includes Nb—Ti—Zr alloy. In addition, the getters can be distributed in a predetermined alignment shape in an electron emission space of the cathode.

The operation of the FED for measuring the vacuum degree, the method for measuring the vacuum degree thereof, and the method for automatically activating the getter thereof will now be described with reference to FIGS. 1 to 6.

When the vacuum degree is changed due to gas molecules outgassed from the panel of the FED, Electrons is emitted from the display emitter 10*a* positioned in the active area of the cathode plate 10 composing the screen of the FED.

The current value of the monitoring emitter 11 applied to the constant voltage Vg-c is changed according to the electrons emitted from the display emitter 10*a* when the monitoring emitter 11 is positioned at the outer portion of the active area of the cathode plate 10.

Here, the current measuring electrode 21 positioned at the outer portion of the active area of the anode plate 20 always is applied to the constant voltage. The current measuring electrode 21 senses variations of the current flowing through the monitoring emitter 11 according to the constant voltage, so that variations of the internal vacuum degree of the FED panel can be monitored according to the variations of the anode current sensed by the electrode 21.

Figure 5:
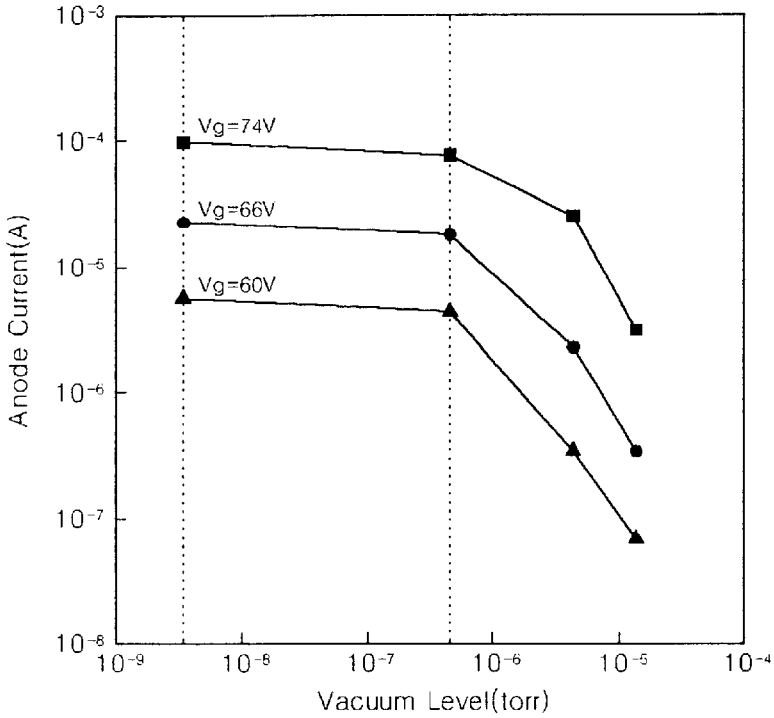
FIG. 5 is a graph showing correlation between a vacuum degree of a panel and a current value of an anode in accordance with the preferred embodiment of the present invention.

Namely, in the measurement of the variations of the anode current according to the vacuum degree of the panel, when the vacuum degree is increased from $10^{-8}$Torr to $10^{-5}$Torr as shown in FIG. 5, the current of the anode is reduced to 2 order.

Figure 6A:
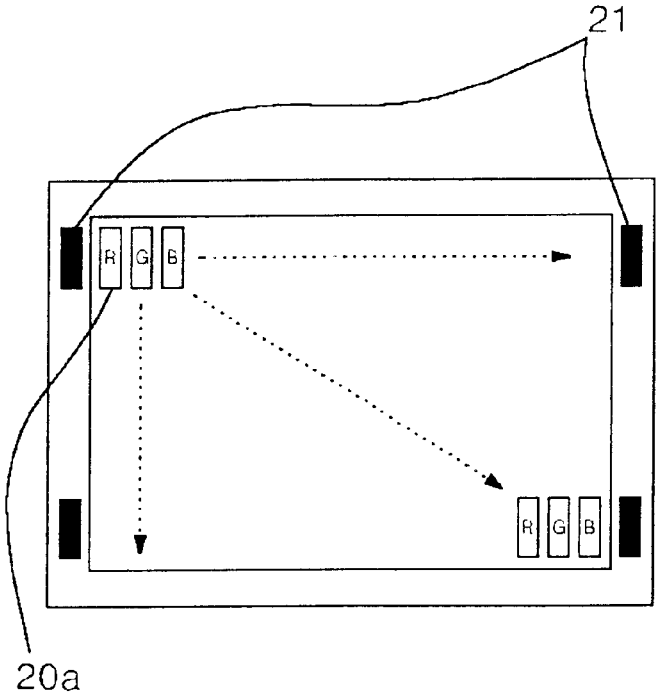
FIG. 6A is an alignment diagram showing an anode plate fluorescent material pixel and a current measuring electrode in accordance with the preferred embodiment of the present invention.
Figure 6B:
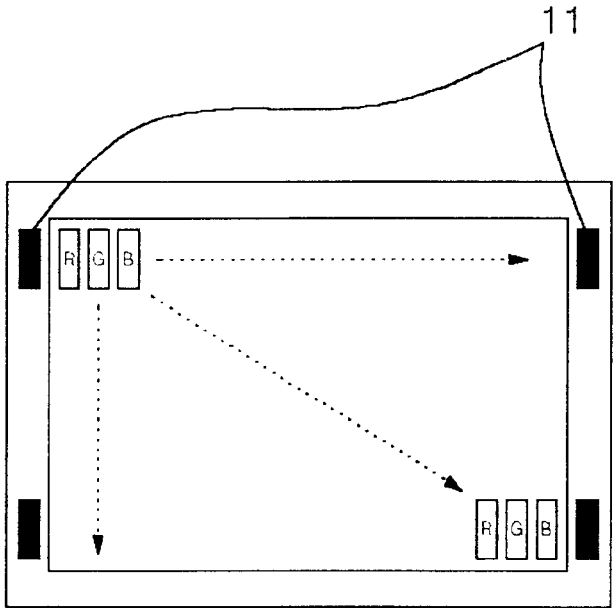
FIG. 6B is an alignment diagram illustrating an active area of a cathode plate and a current measuring emitter in accordance with the preferred embodiment of the present invention.

Here, FIG. 6A is an alignment diagram showing an anode plate fluorescent material pixel and the current measuring electrode, and FIG. 6B is an alignment diagram illustrating the active area of the cathode plate and a current measuring emitter in accordance with the preferred embodiment of the present invention.

On the other hand, the getter 30 should be reactivated to constantly maintain the vacuum degree of the panel measured from the method for measuring the vacuum degree. In accordance with the present invention, a predetermined amount of current flows to the thin film type getter 30, and a getter temperature is increased due to the generated Joule heat, thereby automatically reactivating the getter 30.

That is to say, the aimed vacuum degree and the aimed anode current value are set up according to the optimal operation state of the FED (S300 and S310).

The anode current is measured in the aimed vacuum degree by the voltage Vg-c applied to the monitoring emitter 11, and the voltage applied to the current measuring electrode 21 (S320).

When the measured anode current is fed back to the heating device 40 of the getter 30, the current of the anode is compared with the current value for the aimed vacuum degree. When the current of the anode is reduced from the current value for the aimed vacuum degree below a predetermined range, the heating device 40 is automatically operated to reactivate the getter 30 (S330 and S340).

Here, when the vacuum degree of the FED panel by the reactivation of the getter 30 is constantly maintained during the operation period, the heating device 40 is automatically turned off (S350 and S360).

Still referring to FIG. 4, the getter 30 is a non-evaporation type getter mounted on the cathode plate 10. The getter 30 is deposited in a thin film type on the space between the electrodes of the gate 10*b* according to the sputtering method. Generally, the getter is composed of Nb—Ti—Zr alloy.

As discussed earlier, in accordance with the present invention, the internal vacuum degree of the panel can be monitored during the operation of the FED panel according to the anode current measuring method, without using an external vacuum degree gauge. In addition, the measured variation of the anode current is fed back to the getter heating device, and the getter is often reactivated according to the internal vacuum degree of the panel, thereby preventing the operation of the getter from being deteriorated due to saturation of the gas adsorption. Moreover, the vacuum degree of the panel is maintained below a predetermined value, to increase a life span of the FED and improve reliability during the operation.

While the invention has been shown and described with reference to certain preferred embodiment thereof, it will be understood by those skilled in the art that various changes in form and details may be made therein without departing from the spirit and scope of the invention as defined by the appended claims.

What is claimed is:

1. A field emission display, comprising:

a monitoring emitter applied to a constant voltage, wherein the monitoring emitter is installed at an outer portion of an active area of a cathode plate; and a current measuring electrode applied to a constant voltage to measure the current flowing to the monitoring emitter, wherein the current measuring electrode is disposed at an outer portion of an active area of an anode plate and wherein a getter is automatically activated based on a value associated with measure of the current flowing to the monitoring emitter.

2. The field emission display according to claim 1, wherein the current measuring electrode is positioned to face the monitoring emitter.

3. The field emission display according to claim 1, wherein the constant voltage is applied separately from a display voltage of the cathode plate and the anode plate.

4. A method for measuring a vacuum degree of a field emission display, comprising the steps of:

measuring current variations of a monitoring emitter from electron emission of a display emitter, when the vacuum degree is changed by gas molecules outgassed from a panel of the FED;

monitoring variations of the vacuum degree in the panel of the FED according to the variations of the measured anode current; and automatically reactivating a getter based on a value associated with the current variations of the monitoring emitter.

5. A method for automatically activating a getter of a field emission display, comprising the steps of:

setting up an aimed vacuum degree according to an optimal operation state of the FED;

measuring an anode current flowing through a voltage applied to a monitoring emitter and a voltage applied to a current measuring electrode in the aimed vacuum degree, and feeding back the anode current to a heating device of the getter; and automatically operating the heating device to automatically reactivate the getter, when the fed-back anode current is reduced from a current value for the aimed vacuum degree below a predetermined range.

6. The method according to claim 5, further comprising a step for turning off the heating device when the vacuum degree of the FED panel is constantly maintained during the operation period.

7. The method according to claim 5, wherein the aimed vacuum degree ranges from $10^{-8}$ Torr to $10^{-6}$ Torr.

8. The method according to claim 5, wherein the getter is composed of Nb—Ti—Zr alloy and deposited according to a sputtering method.

9. The method according to claim 5, wherein the getters are distributed in a predetermined alignment shape in an electron emission space of the cathode.

10. A field emission display, comprising:

a monitoring emitter applied to a constant voltage, wherein the monitoring emitter is installed at an outer portion of an active area of a cathode plate, and wherein an inner portion of the active area of the cathode plate comprises at least one display emitter; and a current measuring electrode applied to a constant voltage to measure the current flowing to the monitoring emitter, wherein the current measuring electrode is disposed at an outer portion of an active area of an anode plate.

* * * * *